US005511271A

United States Patent [19]

Shishido et al.

[11] Patent Number: 5,511,271

[45] Date of Patent: Apr. 30, 1996

[54] VIBRATION TYPE FLOOR SWEEPER

[75] Inventors: Osamu Shishido; Yuichi Terada, both of Shizuoka, Japan

[73] Assignee: Amano Corporation, Kanagawa, Japan

[21] Appl. No.: 277,967

[22] Filed: Jul. 20, 1994

[30] Foreign Application Priority Data

Jul. 30, 1993 [JP] Japan ..... 5-208818

[51] Int. Cl.[6] ..... A47L 11/12

[52] U.S. Cl. ..... 15/49.1; 15/50; 15/98; 451/351

[58] Field of Search ..... 15/49.1, 50.1, 15/50.2, 52.2, 97.1, 98, 22.1, 380; 451/351, 356

[56] References Cited

U.S. PATENT DOCUMENTS

| | | | |
|---|---|---|---|
| 2,247,993 | 7/1941 | Fisker | 15/49.1 |
| 2,926,370 | 3/1960 | Wessel | 15/49.1 |
| 3,416,177 | 12/1968 | Young | 15/98 |
| 3,655,444 | 4/1972 | Young | 15/98 |
| 4,183,112 | 1/1980 | Brown et al. | 15/50.1 |

FOREIGN PATENT DOCUMENTS

| | | | |
|---|---|---|---|
| 265461 | 3/1950 | Switzerland | 15/52.2 |
| 1000950 | 8/1965 | United Kingdom | 15/49.1 |

*Primary Examiner*—Edward L. Roberts, Jr.
*Attorney, Agent, or Firm*—Stevens, Davis, Miller & Mosher

[57] ABSTRACT

A vibration type floor sweeper comprising a mounting frame; a motor mounted on the mounting frame; at least two movable supporting points; and a pad or brush having an overall square-shaped configuration movably mounted on a bottom surface of the mounting frame through the movable supporting points, the pad or brush being horizontally vibrated by eccentric operation of the motor.

6 Claims, 4 Drawing Sheets

VIBRATION TYPE FLOOR SWEEPER

BACKGROUND OF THE INVENTION

1. Field of the Invention

This invention relates to a vibration type floor sweeper which is utilized in the technical field of a floor sweeper for polishing and/or scrubbing the floor while manually or automatically operating the same, and more particularly to a vibration type floor sweeper for polishing and/or scrubbing the floor by means of vibrating a pad or brush.

2. Brief Description of the Prior Art

The conventional floor polisher, floor abrasive machine, or floor scrubber is operated to polish and/or scrub the floor by rotating a disk-like or roll-like pad or brush connected to a motor shaft in accordance with the rotation of a motor.

However, the conventional floor sweeper for sweeping the floor with a disk-like or roll-like pad or brush rotated by a motor has the following problems; ① Since the pad or brush is of a circular configuration, it is difficult to sweep angular corner areas of the floor, ② since dusts, cleansing liquid, etc. are scattered circumferentially in accordance with rotation of the pad or brush, it is necessary to attach a dust collector or a large cover member to the nearby area of the pad or brush in order to prevent scattering of dusts, etc., and therefore, the overall size of the sweeper is necessarily increased and the costs are increased, too, ③ since the pad or brush area is covered with a cover member, etc., the area where the pad or brush can sweep is limited due to interruption by the cover member, etc. and there inevitably remains an area where the pad or brush cannot reach, ④ since the amount of motion required for the motor for rotating the pad or brush is large, there is the need of a motor having a larger power to that extent, which inevitably results in a large-sized sweeper and higher costs, ⑤ since the operating sounds of the motor and the dust collector are large, operating noises are higher at the sweeping time and the environmental conditions deteriorate, and ⑥ since the attachment of a larger pad or brush is necessary when the area to be polished and/or scrubbed is vast, the foregoing drawbacks become more manifest.

The invention and its objects and advantages will become more apparent from the detailed description of the preferred embodiments presented below.

OBJECT AND SUMMARY OF THE INVENTION

Therefore, it is an object of the present invention to provide a floor sweeper which is capable of effectively sweeping the floor with a limited amount of noise using a comparatively small-sized motor as a power source and which is capable of beautifully sweeping and scrubbing every angled corner of the floor with the pad or brush.

To achieve the above object, according to the present invention, the following means are provided.

(1) A pad or brush having a square-shaped overall configuration is movably mounted, through at least two movable supporting members, on a bottom surface of a mounting frame with a motor loaded on an upper surface of the mounting frame, the pad or brush being horizontally vibrated by eccentrically operating members fixed to the shaft of the motor.

(2) A set of two pads or brushes having a laterally symmetrical irregular square configuration is movably mounted on a bottom surface of the mounting frame through the movable supporting members, the two pads or brushes being horizontal, but vibrated in opposite directions, by operation of the motor on eccentric members.

(3) The movable supporting points for movably supporting the pad or brush are each formed of a rubber vibration insulator.

(4) The pad or brush movably mounted on the bottom surface of the mounting frame are horizontally vibrated by eccentric operation means such as an eccentric members fixed to said shaft. The eccentric member may be a crank or a cam which is rotated by the motor.

(5) The pad or brush movably mounted on the bottom surface of the mounting frame has an outer surface which is expanded outwardly of an outer surface of the mounting frame.

(6) The motor mounted on the upper surface of the mounting frame has a flat configuration of small height.

(7) The two pads or brushes movably mounted on the bottom surface of the mounting frame have an irregular square configuration such that opposing inner surfaces of the pads or brushes are obliquely inclined relative to an advancing direction of the sweeper.

The above means is operated as follows.

According to the means of the above (1), since the overall configuration of the pad or brush for polishing and/or scrubbing the floor is formed into a square shape and the floor is polished and/or scrubbed while horizontally vibrating the pad or brush instead of rotating the pad or brush by the motor, the pad or brush can positively reach every angled corner of the floor and therefore a complete polishing and/or scrubbing is ensured. Moreover, since the pad or brush is not rotated, a comparatively small-sized motor can be used. Since the need of a provision of a cover member or the like for preventing the scattering of dusts, etc. is eliminated, the whole sweeper can be designed with a small dimension and the costs can be lowered.

According to the means of the above (2), since the respective pads or brushes, which are formed two as a set, are horizontally, but in opposite directions, vibrated by rotation of the motor, the vibrations are offset and shocks to be transmitted to the body side can be minimized. Accordingly, it becomes possible not only to lessen the operator's work load but also to very easily and efficiently polish and/or scrub the floor to the extremity of each angled corner portion using the set of two irregular square shaped pads or brushs.

According to the means of the above (3), since the rubber vibration insulator isolates the vibration noises of the pad or brush and prevent the transmission of the vibrations, generation of operational noises and vibrations can be lessened as much as possible when the floor is swept, thereby preventing deterioration of environment at the time of sweeping and to reduce the work load to the operator.

According to the means of the above (4), since the pad or brush is mechanically horizontally vibrated using such eccentric operation means mounted on a rotated by the motor, a crank or a cam, stableness is enhanced during operation and excellent polishing and scrubbing effects can be exhibited.

According to the means of the above (5), since the outer surface of the pad or brush is expanded outwardly of the mounting frame, even in the case where the angled corner portions of the floor are swept, they can be polished and/or scrubbed with the square pad or brush without allowing the mounting frame to be abutted directly against the wall surfaces of the corner portions. Accordingly, accidental damages to the mounting frame and wall surfaces can be reduced as much as possible during the sweeping operation, and a smooth sweeping operation can be performed.

According to the means of the above (6), since a flat motor is used as a motor for vibrating the pad or brush, it becomes possible to dimension the height of the sweeper body such that the sweeper can be inserted into every corner of the floor even if the corner is narrow.

According to the means of the above (7), since the set of two pads or brushes are inclined in such a manner as to necessarily overlap the opposing inner surfaces with respect to the advancing direction of the sweeper, one of the pads or brushes can always be in contact with the floor even when the pads or brushes are being advanced right ahead. Accordingly, there is no area left unclean on the floor due to a space portion formed between the pads or brushes and therefore, there can be resolved the problem of the failure of sweeping caused by the use of the set of two pads or brushes.

As apparent from the foregoing, the above-mentioned technical problems can be resolved by the above-mentioned means, thereby resolving the problems inherent in the prior art.

DETAILED DESCRIPTION OF THE EMBODIMENT

Preferred embodiments of a vibration type floor sweeper according to the present invention will be described in detail with reference to the accompanying drawings.

Figure 1:
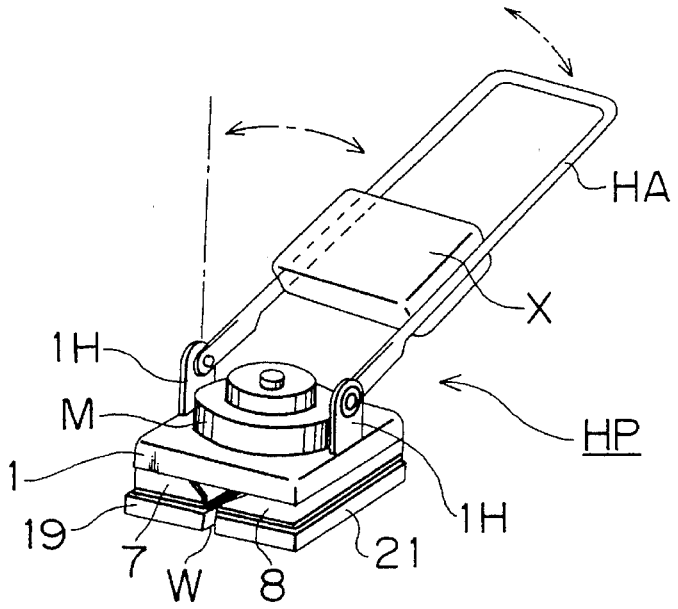
FIG. 1 is a perspective view showing an outer appearance of a handy type floor polisher according to a first embodiment of the present invention.

FIG. 1 is a perspective view showing an outer appearance of a handy type floor polisher HP according to a first embodiment of the present invention. Reference numeral 1 denotes a mounting frame (cover member); M, a small-sized disk-like flat motor as a whole, which is mounted on a central portion of an upper surface of the mounting frame 1; 1H, a pair of brackets projecting from opposite sides of the upper surface of the mounting frame 1; HA, a control handle pivotally mounted on the pair of brackets 1H and 1H; and X, a control box containing a transformer, a rectifier or a battery and provided with various kinds of switches (not shown), respectively. The control box X is mounted on the control handle HA. A lateral width of the control handle HA is smaller than that of the mounting frame 1. An important mechanism, which is illustrated in detail in FIGS. 3 to 5, of the present invention is mounted on a bottom portion of the mounting frame 1 so that the floor can be polished with a pad which will be described later.

Figure 2:
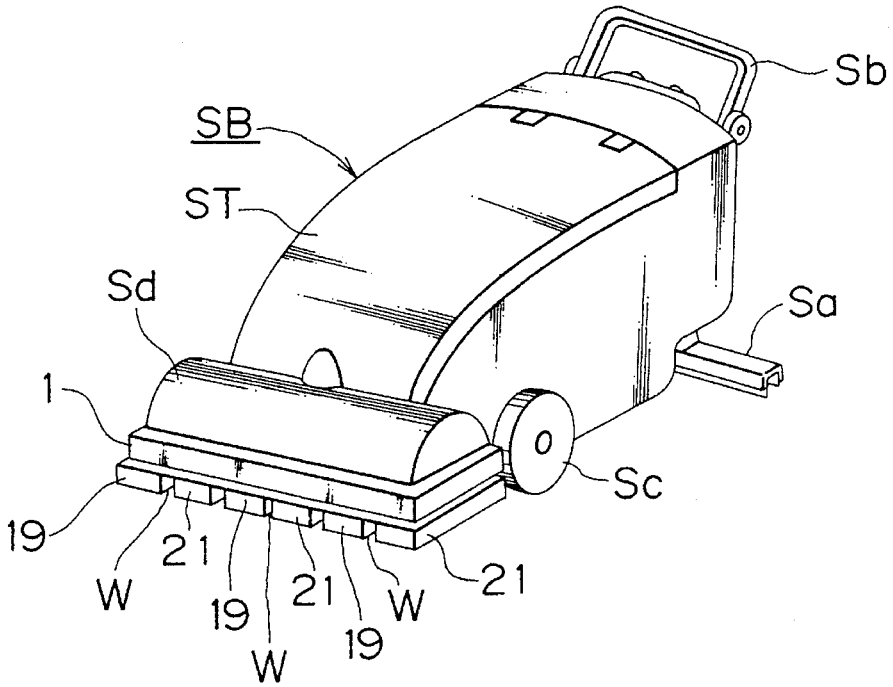
FIG. 2 is a perspective view showing an outer appearance of a self-advancing floor scrubber according to a second embodiment of the present invention.
Figure 3:
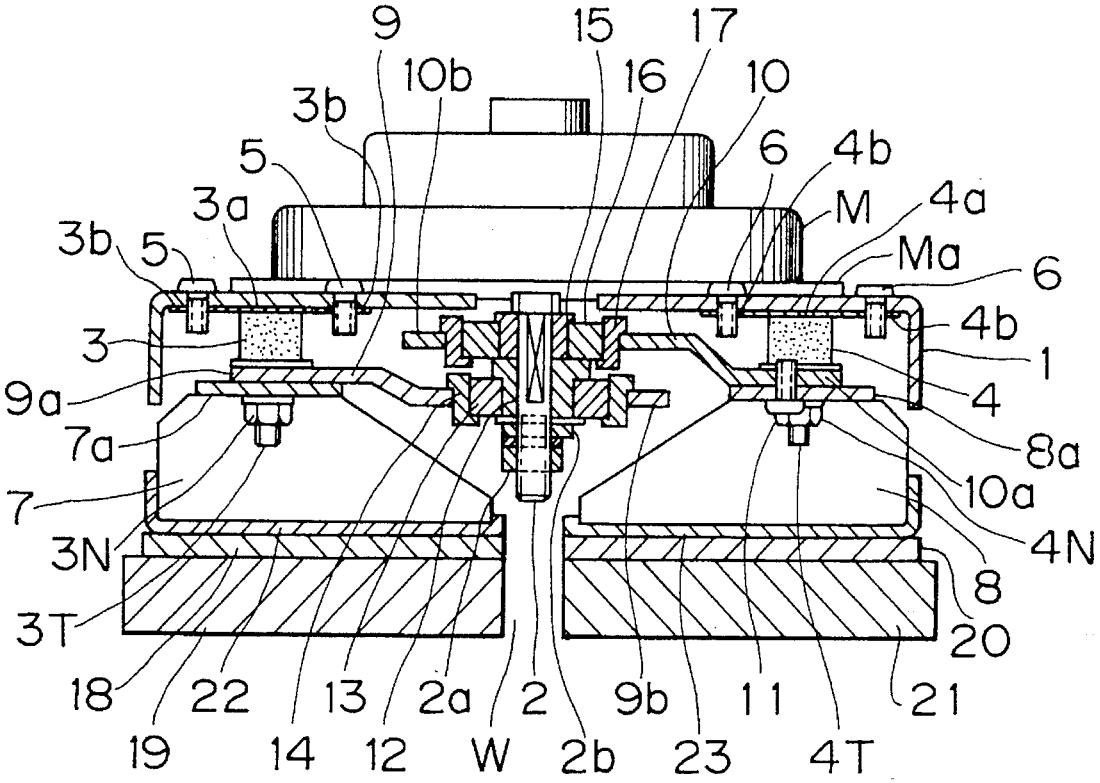
FIG. 3 is a front cross-sectional view showing a mechanism of an important portion of the present invention.
Figure 4:
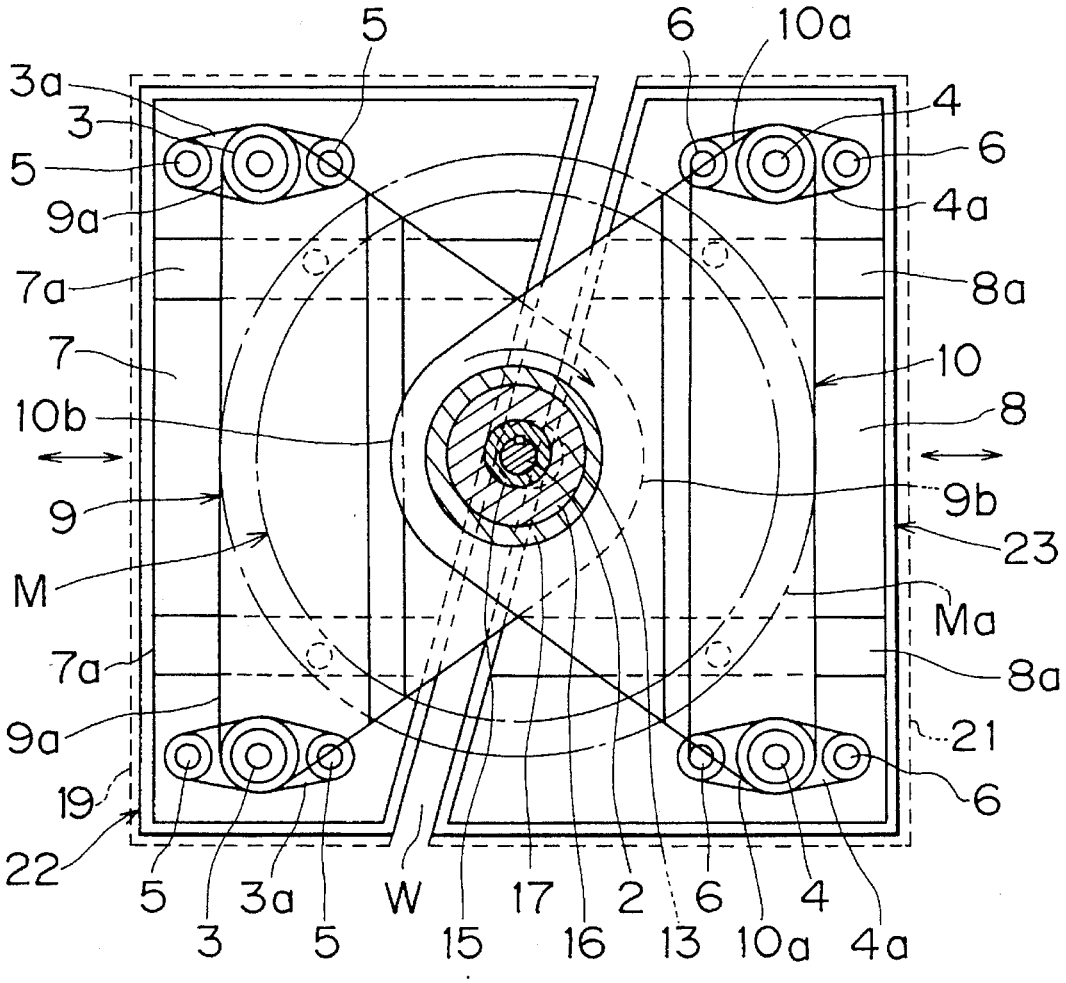
FIG. 4 is a top cross-sectional view likewise showing a mechanism of an important portion of the present invention.
Figure 5:
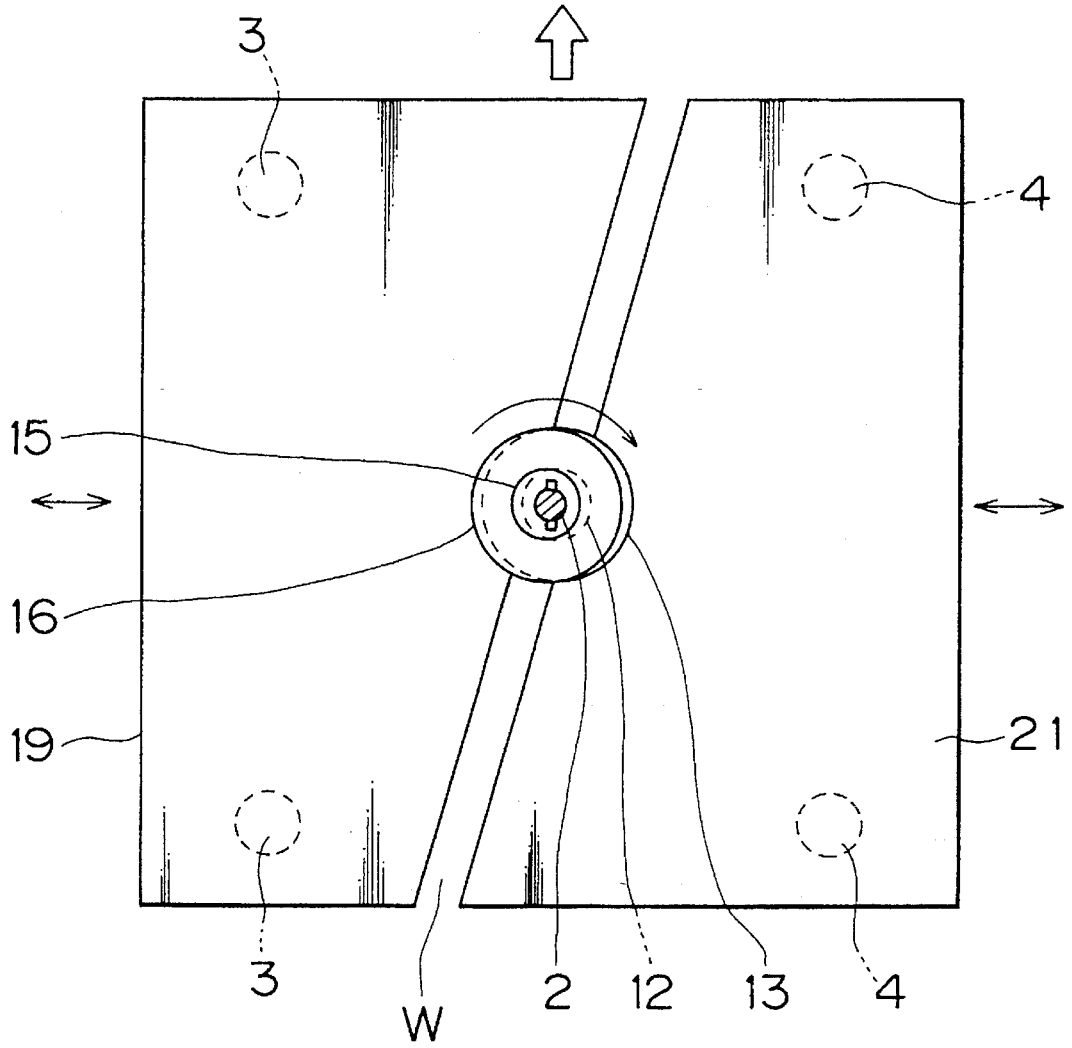
FIG. 5 is a plan view for explaining a vibrating state of a pad or a brush.

FIG. 2 is a perspective view showing an outer appearance of an automatic floor scrubber SB according to a second embodiment of the present invention. Reference characters ST denote a body containing a cleansing liquid tank, a waste water recovery tank, a cleansing liquid supply pump, a waste water recovery pump (all not shown), or the like; Sa, a waste water drawing squeegee; Sb, a driving control handle; Sc, a driving wheel rotated by a motor (not shown); Sd, a cover member mounted on a front surface portion of the body ST; 1, a mounting frame mounted on a bottom surface of the cover member Sd, respectively. The lateral width of the body ST is smaller than that of the mounting frame 1. Three sets of important mechanisms of the present invention illustrated in detail in FIGS. 3 to 5 are laterally arranged side by side on the bottom portion of the mounting frame 1. Owing to this arrangement, the floor can be scrubbed by a brush as later described while supplying a cleansing liquid from the cleansing liquid supply pump.

FIG. 3 is a front sectional view of an important mechanism of the present invention, and FIG. 4 is a plan sectional view of the same. In FIGS. 3 and 4, reference numeral 2 denotes a rotary shaft of the flat motor M; 9 and 10, a pair of vibration plates formed in a generally triangular shape as a whole, which are movably attached at opposite side end portions 9*a*, 9*a* and 10*a*, 10*a* of the mounting frame 1 through rubber vibration insulators 3, 3 and 4, 4, respectively. Reference numerals 3*a* and 4*a* denotes mounting flanges of the rubber vibration insulators 3 and 4, respectively. Reference numerals 5 and 6 denote screws for movably attaching the flanges 3*a* and 4*a* to a bottom surface portion of the mounting frame 1, respectively. Reference numerals 3*b* and 4*b* denote elongated holes for the screws 5 and 6, respectively. Reference numerals 3T, 3N and 4T, 4N denote mounting bolts and nuts for the rubber vibration insulators 3 and 4, respectively.

Reference numerals 7 and 8 denote a pair of mounting plates attached to bottom surfaces of the vibration plates 9 and 10 and having an upwardly-directed generally U-shaped configuration in section; 7*a*, 7*a* and 8*a*, 8*a*, mounting surfaces which are formed, in their bent postures, on upper surface of opposite end portions thereof; and 22 and 23, laterally symmetric irregular square-shaped mounting bases fixed to the bottom surfaces of the mounting plates 7 and 8, respectively. Attached respectively to bottom surfaces of the mounting bases 22 and 23 through cushioning sponges 18 and 20 are a pair of pads or brushes 19 and 21 which are formed in laterally symmetric irregular square-shaped configurations like the mounting bases 22 and 23 and whose upper and lower opposite sides, as well as laterally opposite outer side surfaces, have somewhat larger sizes than the mounting bases 22 and 23. These pair of pads or brushes 19 and 21 are removably attached without the use of magic fasteners (not shown).

Likewise, in FIGS. 3 and 4, reference character W denotes an opposing distance between the pads or brushes 19 and 21. This distance W is obliquely formed relative to the proceeding direction (upward direction in FIGS. 4 and 5) by forming the pair of pads or brushes 19 and 21 into deformed square shapes, respectively, as shown in FIGS. 4 and 5. It is designed such that even in the case where the pads or brushes are advanced right ahead, there remains no area left unclean at the opposing distance W portion.

Next, reference numerals 12 and 15 respectively denote lower and upper eccentric members secured to the rotary shaft 2 of the flat motor M. Reference numerals 14 and 17 respectively denote bearing metals fitted to the periphery of each bearing 13 and 16. The lower and upper bearing metals 14 and 17 are mounted on distal end portions 9*b* and 10*b* of the pair of vibration plates 9 and 10. When the flat motor M rotates the rotary shaft 2, the pair of vibration plates 9 and 10 are horizontally vibrated about the rubber vibration insulators 3, 3 and 4, 4 acting as supporting points by means of rotations of the eccentric members 12 and 15. The pair of pads or brushes 19 and 21 mounted on the bottom surface are horizontally vibrated by means of vibrations of the vibration plates 9 and 10.

The lower and upper eccentric shafts 12 and 15 are opposite in eccentric direction so that the pair of vibration plates 9 and 10 are vibrated in opposite directions to offset the vibrations. In FIG. 3, reference numerals 2*a* and 2*b* respectively denote fastening nut and spacer which are mounted on the rotary shaft 2.

Since the construction of a vibration type floor sweeper is such as mentioned above, when the flat motor M rotates the rotary shaft 2, the eccentric members 12 and 15 horizontally, but in opposite directions, vibrate the pair of vibration plates 9 and 10 about the rubber vibration insulators 3, 3 and 4, 4 acting as supporting points as shown in FIG. 5. As a result, the pads or brushes 19 and 21 attached to the pair of vibration plates 9 and 10 are also vibrated in the opposite horizontal directions. Accordingly, when the pads or brushes 19 and 21 are pressed against the floor, even a narrow angular portion and an angled corner portion, which are difficult to sweep with the conventional disk-like or roll-like pads or brushes, can easily be polished and/or scrubbed. If one set of such constructed pads or brushes are mounted on the handy type floor polisher HP as shown in FIG. 1 or if a plurality of sets of such constructed pads or brushes are mounted, side by side, on the floor scrubber SB as shown in FIG. 2, excellent polishing and scrubbing effects can be exhibited. Instead of providing the pads or brushes 19 and 21 as a set as illustrated, a single pad or brush may be horizontally vibrated so as to be used as means for polishing and/or scrubbing of the floor scrubber.

Since the pair of vibration plates 9 and 10 are mounted on the mounting frame 1 through the rubber vibration insulators 3, 3 and 4, 4, the vibrations and vibrating noises of the vibration plates 9 and 10 are cut off by the rubber vibration insulators 3, 3 and 4, 4. Accordingly, noises and vibrations can be minimized during operation. Furthermore, since the pair of vibration plates 9 and 10 are vibrated in opposite directions by the eccentric members 12 and 15, the vibrations are offset to minimize the vibrations during operation.

Furthermore, since the flat motor M having an overall flat configuration is used as a motor for rotating the rotary shaft 2 and the outer surfaces of the pair of pads or brushes 19 and 21 are allowed to project outwardly of the outer surface of the mounting frame 1, even a narrow corner portion of the floor can easily and completely be swept by means of horizontal vibrations of the pads or brushes 19 and 21 without damaging the wall surface, etc. Since the opposing direction W between the pair of pads or brushes 19 and 21 are obliquely provided with respect to the proceeding direction, the floor can completely be polished and/or scrubbed without leaving any unclean area.

As described in the foregoing, according to a vibration type floor sweeper of the present invention, the floor can be polished and/or scrubbed very smoothly and even an angular corner portion of the floor can easily be swept. Since the pads or brushes are not rotated, a flat small-sized motor can be used. As a result, the whole size of the sweeper can be designed with a small dimension. Because of the reasons set forth hereinabove, the present invention is suitably applicable to various types of floor sweepers such as a floor polisher, a floor scrubber, a floor abrasive machine, and the like.

The invention has been described with particular reference to preferred illustrative embodiments thereof, but it will be understood that variations and modifications can be effected within the spirit and scope of the invention.

What is claimed is:

1. A vibration type floor sweeper comprising a mounting frame; a motor with shaft mounted on said mounting frame; two eccentric members oppositely fixed to said shaft; plate means slidably mounted on each of said eccentric members and extending outwardly therefrom in opposite directions from said shaft; said plate means having outer ends, vibration damping means interconnecting said plate means at said outer ends and said mounting frame; and a set of two pads or brushes having a laterally symmetrical irregular square configuration, said set of two pads or brushes being fixed to said plate means, each of said two pads or brushes being horizontal, but vibrated in opposite directions, by operation of said motor on said two eccentric members through rotation of said shaft.

2. The vibration type floor sweeper as claimed in claim 1, in which said two pads or brushes have such an irregular square configuration that opposing inner surfaces of said pads or brushes are obliquely inclined relative to an advancing direction of said sweeper.

3. The vibration type floor sweeper as claimed in claim 1, wherein said vibration damping means are each formed of rubber vibration insulators.

4. The vibration type floor sweeper as claimed in claim 1, in which said two pads or brushes movably mounted on the bottom surface of said mounting frame are horizontally vibrated in opposite directions by indirect contact with said eccentric members mounted on said shaft rotated by said motor.

5. The vibration type floor sweeper as claimed in claim 1, in which said two pads or brushes movably mounted on said bottom surface of said mounting frame have outer surfaces which are expanded outwardly of an outer surface of said mounting frame.

6. The vibration type floor sweeper as claimed in claim 1, in which said motor is mounted on an upper surface of said mounting frame, said motor having a flat configuration of small height.

* * * * *